US008764459B2

(12) United States Patent
Decker et al.

(10) Patent No.: US 8,764,459 B2
(45) Date of Patent: Jul. 1, 2014

(54) CONNECTOR ASSEMBLIES FOR CONNECTOR SYSTEMS

(75) Inventors: Donald Francis Decker, Harrisburg, PA (US); George Irwin Peters, Jr., Harrisburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 49 days.

(21) Appl. No.: 13/550,729

(22) Filed: Jul. 17, 2012

(65) Prior Publication Data

US 2014/0024269 A1 Jan. 23, 2014

(51) Int. Cl.
*H01R 12/00* (2006.01)

(52) U.S. Cl.
USPC ..... 439/83

(58) Field of Classification Search
USPC ..... 439/83, 82, 835, 567, 581; 361/761
See application file for complete search history.

(56) References Cited

U.S. PATENT DOCUMENTS

| | | | | |
|---|---|---|---|---|
| 4,978,315 | A | 12/1990 | Edgley et al. | |
| 5,494,456 | A | 2/1996 | Kozel et al. | |
| 5,586,008 | A * | 12/1996 | Kozel et al. | 361/743 |
| 6,280,246 | B1 * | 8/2001 | Sawayanagi | 439/567 |
| 6,287,130 | B1 * | 9/2001 | Torii | 439/83 |
| 6,607,400 | B1 * | 8/2003 | Ko | 439/581 |
| 6,824,399 | B2 * | 11/2004 | Smith et al. | 439/82 |
| 7,074,054 | B2 * | 7/2006 | Mertz et al. | 439/78 |
| 7,175,469 | B1 * | 2/2007 | Daily et al. | 439/441 |
| 7,660,128 | B2 * | 2/2010 | Crews et al. | 361/761 |
| 7,780,467 | B2 * | 8/2010 | Daily | 439/440 |
| 8,215,995 | B1 * | 7/2012 | Little et al. | 439/638 |
| 8,550,838 | B2 * | 10/2013 | Osagle et al. | 439/441 |
| 2006/0030207 | A1 | 2/2006 | Mertz et al. | |
| 2010/0068925 | A1 * | 3/2010 | Daily | 439/567 |

FOREIGN PATENT DOCUMENTS

| | | |
|---|---|---|
| EP | 2 139 079 A2 | 12/2009 |
| EP | 2 333 407 A1 | 6/2011 |

OTHER PUBLICATIONS

European Search Report, Mail Date Sep. 20, 2013, EP 13 17 6904, Application No. 13176904.4-1801.

* cited by examiner

*Primary Examiner* — Alexander Gilman

(57) ABSTRACT

A connector system includes a substrate having a front side and a rear side with an opening therethrough, and a connector assembly coupled to the substrate. The connector assembly includes a housing having a body at a bottom and a head at a top that extends along the front side with the body extending through the opening to the rear side. The housing has a contact channel extending therethrough. A poke-in contact is received in the contact channel through the top of the housing. The poke-in contact has a wire trap configured to receive a wire therein in a wire loading direction through the bottom of the housing. The poke-in contact has a mounting leg extending from the head and mounted to the front side of the substrate.

20 Claims, 3 Drawing Sheets

CONNECTOR ASSEMBLIES FOR CONNECTOR SYSTEMS

BACKGROUND OF THE INVENTION

The subject matter herein relates generally to connector assemblies for connector systems.

Many known connectors are mounted on a top side of a circuit board and protrude upward from the circuit board. These connectors include electrical contacts that are electrically connected to conductive traces in the circuit board or to wires that extend along the surface and/or sides of the circuit board. The connectors have a mating interface configured to mate with a mating connector. The mating interface typically is located parallel or perpendicular with respect to the top side of the circuit board.

These known connectors may have a height profile above the top side of the circuit board that is too large for certain applications. For example, the profile of many connectors used in conjunction with light emitting diodes ("LEDs") may be so large relative to the LEDs that the connectors impede or block some of the light emitted by the LEDs. Additionally, the trend towards smaller electronic devices and more densely packed electronic devices and connectors on a circuit board requires the reduction of the height profile for connectors.

A need exists for a connector having a smaller profile than known connectors. Such a connector may be useful in devices where a smaller connector height profile is desired, such as in LED lighting devices.

BRIEF DESCRIPTION OF THE INVENTION

In one embodiment, a connector assembly is provided for mounting to a substrate having an opening extending between a front side and a rear side. The connector assembly includes a housing having a body at a bottom of the housing and a head at a top of the housing. The head extends from the body and is wider than the body. The head is configured to be mounted to the front side of the substrate with the body extending through the opening of the substrate to the rear side of the substrate. The housing has a contact channel extending therethrough that is open at the top and the bottom of the housing. The connector assembly includes a poke-in contact received in the contact channel. The poke-in contact has a wire trap configured to receive a wire therein in a wire loading direction through the bottom of the housing from the rear side of the substrate. The poke-in contact has a mounting leg extending from the head that is configured to be mounted to the front side of the substrate.

In a further embodiment, a connector assembly is provided for mounting to a substrate having an opening extending between a front side and a rear side. The connector assembly includes a housing configured to extend through the opening of the substrate such that a portion of the housing is forward of the front side of the housing and such that a portion of the housing is rearward of the rear side of the housing. The housing has a contact channel extending therethrough that is configured to receive a wire through a bottom of the housing. A poke-in contact is received in the contact channel. The poke-in contact has a wire trap configured to receive a wire therein in a wire loading direction from the rear side of the substrate. The poke-in contact has a mounting leg having a mounting surface. The mounting leg extends from the housing proximate to a top of the housing. The mounting surface is configured to be mounted to the front side of the substrate and faces the bottom of the housing.

In a further embodiment, a connector system is provided that includes a substrate having a front side and a rear side with an opening therethrough, and a connector assembly coupled to the substrate. The connector assembly includes a housing having a body at a bottom of the housing and a head at a top of the housing. The head extends along the front side of the substrate and the body extends from the head through the opening such that the bottom is rearward of the rear side. The housing has a contact channel extending therethrough that is open at the top and the bottom of the housing. A poke-in contact is received in the contact channel through the top of the housing. The poke-in contact has a wire trap configured to receive a wire therein in a wire loading direction through the bottom of the housing. The poke-in contact has a mounting leg extending from the head and mounted to the front side of the substrate.

DETAILED DESCRIPTION OF THE INVENTION

Figure 1:
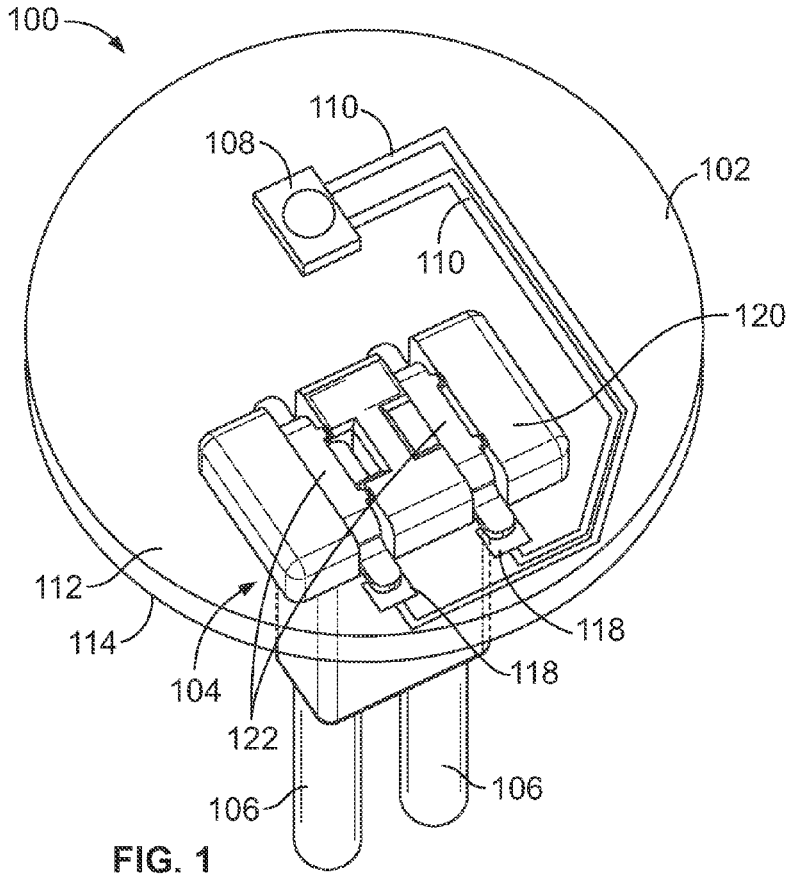
FIG. 1 is a front perspective view of a connector system formed in accordance with one embodiment.

FIG. 1 is a front perspective view of a connector system 100 formed in accordance with one embodiment. The connector system 100 includes a substrate 102 and a connector assembly 104 mounted to the substrate 102. A cable or wire 106 is directly terminated to the connector assembly 104. In an exemplary embodiment, the connector assembly 104 is a poke-in type of connector, where the wire 106 is coupled to the connector assembly 104 by a simple poke-in wire termination. The poke-in termination offers quick and reliable wire termination as a low-labor alternative to hand-soldering of the wire 106 either directly to the substrate 102 or to a contact or other component.

In an exemplary embodiment, the connector system 100 may be part of a lighting system, such as an LED lighting system. For example, one or more LEDs 108 may be mounted to the substrate 102 in the vicinity of the connector assembly 104. The connector assembly 104 may be electrically connected to the LEDs 108 by traces 110 on the substrate 102. The connector assembly 104 supplies power and or control functions to the LEDs 108. The wire 106 supplies power to the connector assembly 104. The connector system 100 may have use in other fields or for other applications in alternative embodiments other than supplying power to LEDs.

The substrate 102 includes a front side 112 and a rear side 114. An opening 116 (shown in FIG. 5) extends through the substrate 102 between the front and rear sides 112, 114. The LEDs 108 and traces 110 are routed along the front side 112. The substrate 102 is a substantially flat supporting layer that may mechanically support the connector assembly 104 and may electrically connect the connector assembly 104 with one or more peripheral devices, including the LEDs 108 via the traces 110. In an exemplary embodiment, the substrate 102 may include a metal clad circuit board having an aluminum base or other metal base that provides very efficient thermal heat dissipation, such as for the LEDs 108. Other embodiments of the substrate 102 may be used in one or more alternative embodiments, such as an FR4 circuit board.

The connector assembly 104 is electrically connected to the substrate 102 at the front side 112, such as at mounting pads 118 on the front side 112. The connector assembly 104 extends through the opening 116 to the rear side 114. In the illustrated embodiment, the housing 120 at least partially protrudes through the opening 116 such that the bottom of the housing 120 is located proximate to and past the rear side 114 of the substrate 102. In another embodiment, the bottom of the housing 120 is substantially flush with the rear side 114 of the substrate 102. In another embodiment, the bottom of the housing 120 is partially recessed in the opening 116.

The wire 106 is terminated to the connector assembly 104 at the rear side 114. For example, the wire 106 may be loaded into the connector assembly 104 through the rear side 114. Such a system allows the wire 106 to remain in the fixture or can that holds the connector system 100, which makes for easier, more direct termination by reducing routing of the wire 106. Such a system keeps the wire 106 on the rear side 114 of the substrate 102. The wire 106 does not need to be routed to the front side 112 to make an electrical connection to the substrate 102 or a connector on the front side 112. The wire 106 is thus not routed near the LEDs 108. The wire 106 does not block the light produced by the LEDs 108. The connector assembly 104 has a low profile so as to not detrimentally affect the lighting pattern of the LEDs 108. The profile of the connector assembly 104 is controllable, as compared to, for example, routing of the wire 106 along the front side 112.

The connector assembly 104 includes a housing 120 and one or more poke-in contacts 122. In the illustrated embodiment, the connector assembly 104 includes two poke-in contacts 122, however any number of poke-in contacts 122 may be utilized. The poke-in contacts 122 are mounted to the front side 112 of the substrate 102 and the poke-in contacts 122 receive corresponding wires 106 from the rear side 114 of the substrate 102. The housing 120 extends through the opening 116 in the substrate 102, positioning the housing 120 on both sides 112, 114 of the substrate 102. Having the housing 120 extending through the substrate 102 allows the termination of the poke-in contacts 122 on the front side 112 while still allowing the termination to the wires 106 on the rear side 114.

In an exemplary embodiment, the connector system 100 is arranged such that the substrate 102 is oriented generally horizontally with the housing 120 extending generally vertically through the substrate 102. The front side 112 is positioned generally vertically above the rear side 114. The LEDs 108 are positioned on the top and the wire 106 is loaded into the connector assembly 104 from the bottom. The wire loading direction is oriented generally vertically. Such orientation is merely one example of a possible orientation, but it is realized that other orientations are possible, including an orientation that was rotated 180° with the LEDs 108 positioned on the bottom, an orientation that was rotated 90° with the substrate 102 oriented vertically, or other orientations. The description herein will be with reference to an orientation with the substrate 102 being horizontal and the LEDs 108 on the top.

Figure 2:
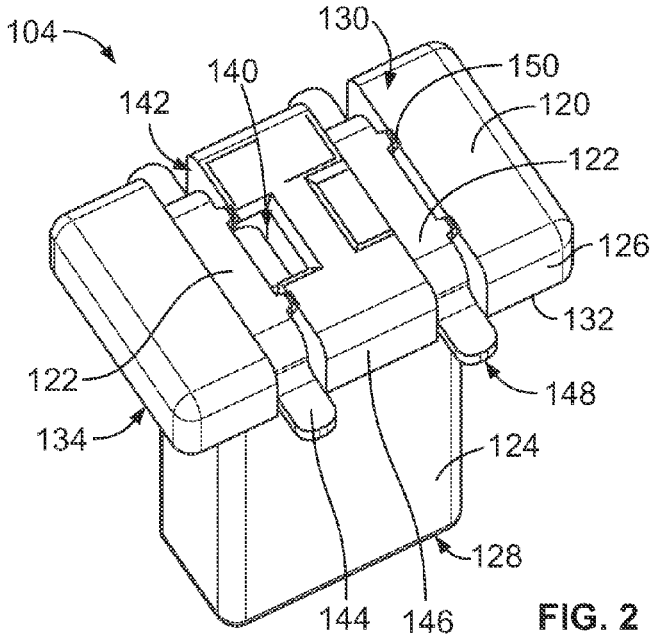
FIG. 2 is a top perspective view of a connector assembly for the connector system.
Figure 3:
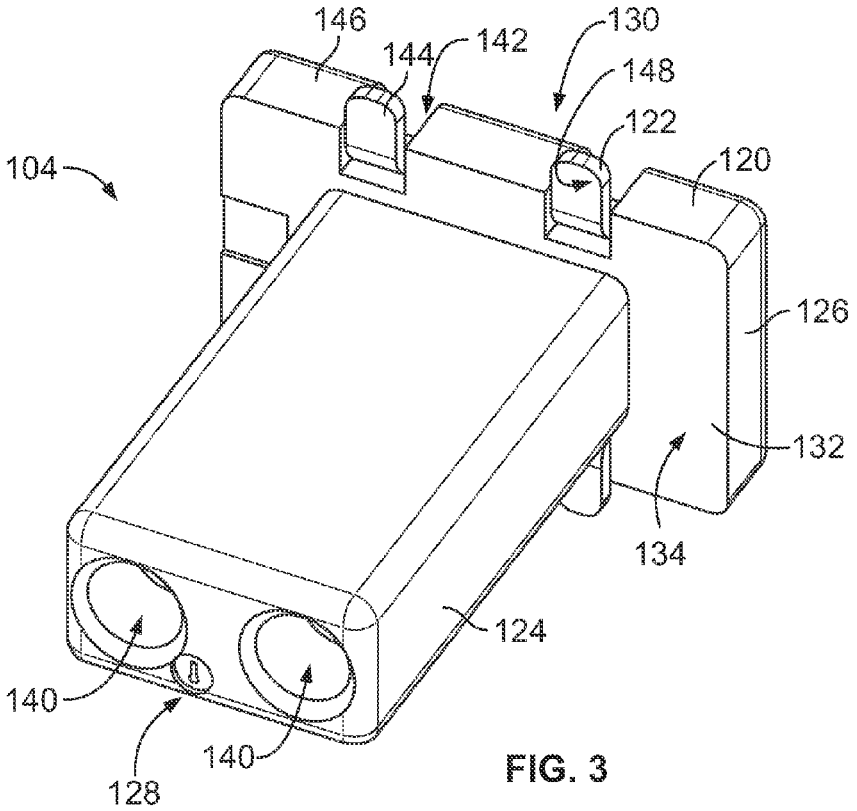
FIG. 3 is a bottom perspective view of the connector assembly.

FIG. 2 is a top perspective view of the connector assembly 104. FIG. 3 is a bottom perspective view of the connector assembly 104. The housing 120 includes a body 124 and a head 126. The body 124 extends from the head 126 to a bottom 128 of the housing 120. A top 130 of the housing 120 is defined by the head 126 generally opposite to the body 124. The head 126 is wider than the body 124 in at least one dimension (e.g. longitudinally and/or laterally). The body 124 is sized to extend through the opening 116 in the substrate 102 (both shown in FIG. 1). The head 126 is sized larger than the opening 116 and is configured to be seated against the front side 112 (shown in FIG. 1) of the substrate 102 when the body 124 is loaded into the opening 116. The head 126 may limit how far the housing 120 may be inserted into the opening 116. In an exemplary embodiment, the housing 120 includes and/or is formed from a dielectric material, such as a plastic material.

The head 126 includes a ledge 132 along a head bottom 134, which is defined by the bottom surface of the head 126 generally opposite the top 130. The ledge 132 extends to the body 124. The ledge 132 is downward facing and is configured to face and/or abut against the front side 112. The ledge 132 faces the bottom 128 of the housing 120.

The housing 120 includes contact channels 140 extending therethrough that receive the poke-in contacts 122. In an exemplary embodiment, the contact channels 140 extend entirely through the housing 120 and are open at the top 130 and the bottom 128. The contact channels 140 receive the poke-in contacts 122 through the top 130. The contact channels 140 receive the wires 106 (shown in FIG. 1) through the bottom 128. The contact channels 140 are sized and shaped to hold the poke-in contacts 122. The contact channels 140 are sized and shaped to receive and guide the wires 106 to the poke-in contacts 122.

The housing 120 includes contact slots 142 at the top 130. The contact slots 142 receive portions of the poke-in contacts 122. In an exemplary embodiment, the poke-in contacts 122 have one or more mounting legs 144. The mounting legs 144 are used to mechanically and electrically couple the poke-in contacts 122 to the substrate 102. For example, the mounting legs 144 may be soldered to the substrate 102. The contact slots 142 receive the mounting legs 144. The contact slots 142 extend from the contact channels 140 to outer edges 146 of the housing 120. The contact slots 142 allow the mounting legs 144 to be routed from the contact channels 140 to the outer edges 146. The mounting legs 144 have mounting surfaces 148 that are oriented for termination to the corresponding mounting pads 118. In an exemplary embodiment, the mounting surfaces 148 are oriented generally coplanar with the ledge 132 at the head bottom 134 for mounting to the front side 112 of the substrate 102. The mounting surfaces 148 face the bottom 128 of the housing 120.

In an exemplary embodiment, the poke-in contacts 122 have locking barbs 150 extending therefrom that dig into the housing 120 within the contact slots 142 to hold the poke-in contacts 122 in the contact slots 142. The locking barbs 150 provide holding force to hold the poke-in contacts 122 in the contact slots 142 during mounting of the connector assembly 104 to the substrate 102. The locking barbs 150 provide holding force to hold the poke-in contacts 122 in the contact slots 142 during insertion of the wire 106 into the contact channels 140. Other types of securing features may be used in alternative embodiments to hold the poke-in contacts 122 in the housing 120.

Figure 4:
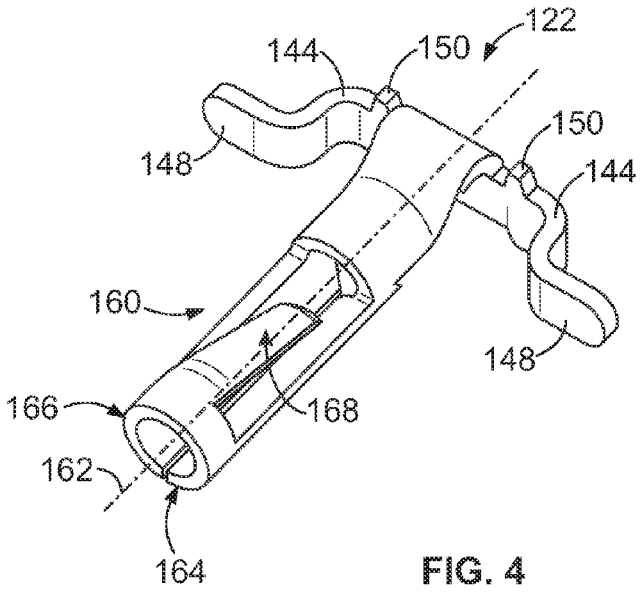
FIG. 4 is a bottom perspective view of a poke-in contact for the connector assembly.

FIG. 4 is a bottom perspective view of the poke-in contact 122. The poke-in contact 122 includes a wire trap 160 configured to receive the wire 106 (shown in FIG. 1) to electrically connect the poke-in contact 122 to the wire 106. A pair of mounting legs 144 extends from the wire trap 160 at a top of the poke-in contact 122. Any number of mounting legs 144 may be provided, including a single mounting leg 144. The locking barbs 150 extend from the mounting legs 144 at the top. The locking barbs 150 may be provided at different locations in alternative embodiments.

The wire trap 160 generally extends along a longitudinal axis 162 from the mounting legs 144 at the top to a wire receiving end 164 at a bottom of the wire trap 160. The wire trap 160 includes a barrel 166 configured to receive the wire 106 therein. The wire trap 160 includes a spring finger 168 extending into the barrel 166 to engage the wire 106 when the wire 106 is loaded into the barrel 166. The spring finger 168 is held against the wire 106 by a spring force to ensure electrical contact with the wire 106. Optionally, multiple spring fingers 168 may extend into the barrel 166 to engage different sides of the wire 106. The end of the spring finger 168 may dig into the wire 106 to resist pull out of the wire 106. In an exemplary embodiment, the poke-in contact 122 is stamped and formed. The barrel 166 is shaped by bending two edges of the poke-in contact 122 into a barrel shape to meet at a seam. Optionally, the spring finger 168 may be generally opposite the seam. The spring finger 168 is stamped out of the poke-in contact 122 and bent inward into the barrel 166.

The mounting legs 144 are bent or shaped such that the mounting surfaces 148 are oriented along a plane generally perpendicular to the longitudinal axis 162. The mounting legs 144 may define spring legs that are configured to be held against the substrate 102 by a spring force. Optionally, the mounting legs 144 may be slightly angled downward, such that the mounting legs 144 are deflected upward when mounted to the substrate 102.

Figure 5:
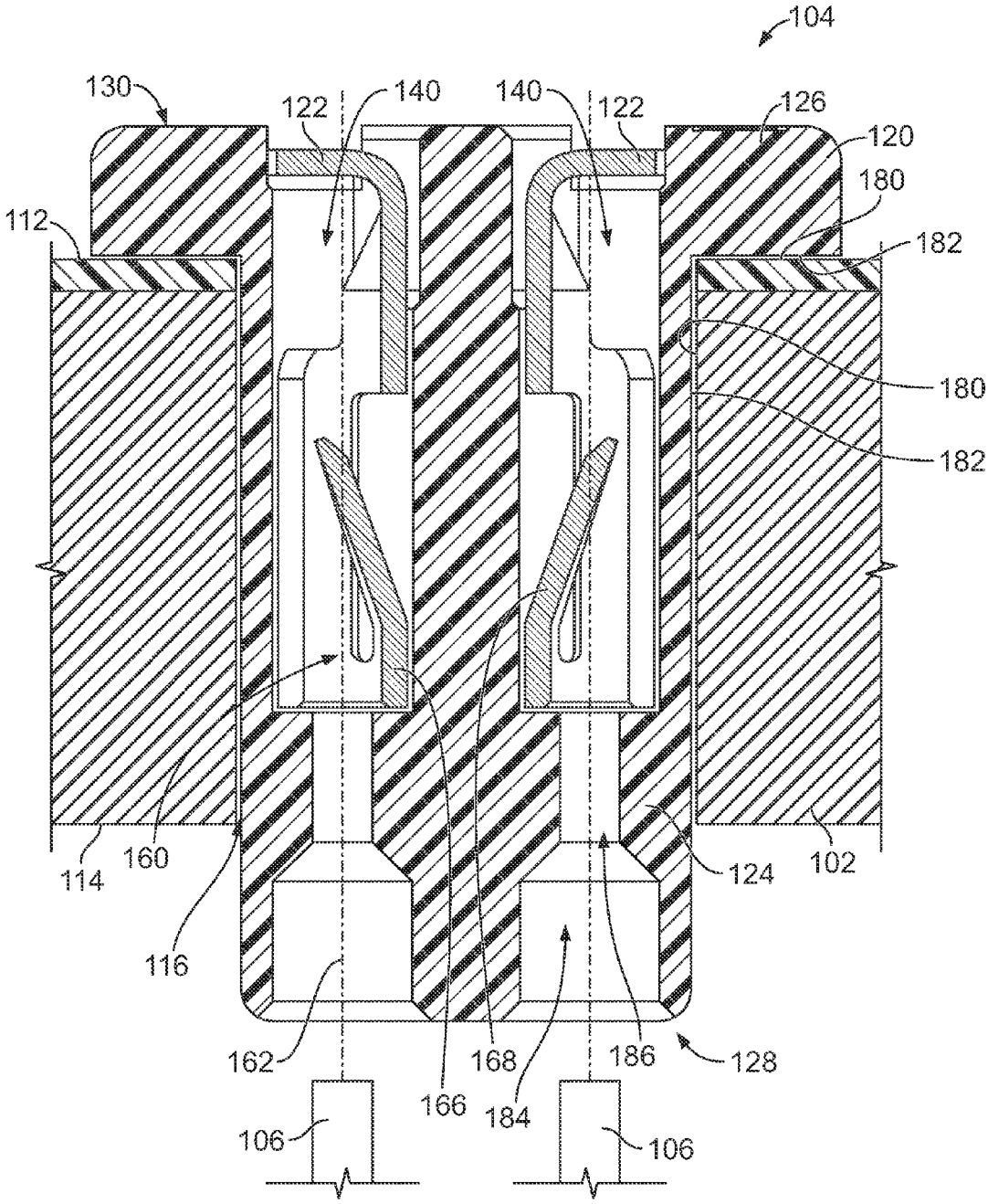
FIG. 5 is a cross-sectional view of the connector assembly.

FIG. 5 is a cross-sectional view of the connector assembly 104. The poke-in contacts 122 are loaded into the contact channels 140. In an exemplary embodiment, the poke-in contacts 122 are loaded into the contact channels 140 through the top 130. The mounting legs 144 extend along the head 126. The wire traps 160 are loaded into the contact channels 140 and are located in the body 124.

The substrate 102 is illustrated in FIG. 5, showing the connector assembly 104 loaded through the opening 116. The opening 116 is defined by walls 180 of the substrate 102. The housing 120 includes substrate engagement surfaces 182 that engage the substrate 102. The substrate engagement surfaces 182 extend along the body 124. The body 124 is generally positioned within the plane of the substrate 102, but may extend beyond the rear side 114. In an exemplary embodiment, the wire traps 160, when loaded into the body 124 are aligned with the plane of the substrate 102 (e.g. vertically aligned). For example, the barrels 166 and spring fingers 168 are positioned between the front and rear sides 112, 114. In alternative embodiments, the wire traps 160 may only be partially aligned with the plane of the substrate 102, with a portion of the wire traps 160 extending beyond the rear side 114. In other alternative embodiments, the wire traps 160 may not be aligned with the substrate 102, but rather the entire wire traps 160 are positioned beyond the rear side 114.

The contact channels 140 are sized and shaped to guide the wires 106 into the wire traps 160. At the bottom 128, the contact channels 140 include funnels 184 that receive the wires 106 and guide the wires 106 into ports 186 that are generally centered along the contact channels 140. The ports 186 may have smaller diameters than other portions of the contact channels 140 to locate the wires 106 along the longitudinal axes 162 of the poke-in contacts 122. The ports 186 position the wires 106 to ensure that the wires 106 will engage the spring fingers 168 when pushed into the connector assembly 104. The ports 186 may have diameters that are approximately equal to the diameters of the wires 106 such that the wires 106 are somewhat restricted from movement (e.g. side-to-side) within the connector assembly 104.

A connector assembly 104 is provided that is inverted such that the connector assembly 104 extends through the substrate 102. The connector assembly 104 is thus mounted to the front side 112 but yet is also accessible at the rear side 114 for termination to the wire 106. The connector assembly 104 utilizes the poke-in contacts 122 for quick termination of the wire 106 to the connector assembly 104. The wire 106 remains on the rear side 114 of the substrate 102 and does not block other components on the front side 112, such as the lighting pattern of the LEDs 108 on the front side 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mounting to a substrate having an opening extending between a front side and a rear side, the connector assembly comprising:

a housing having a body at a bottom of the housing and a head at a top of the housing, the head extending from the body, the head being wider than the body and being configured to be mounted to the front side of the substrate with the body extending through the opening of the substrate to the rear side of the substrate, the housing having a contact channel extending therethrough being open at the top and the bottom of the housing; and a poke-in contact received in the contact channel, the poke-in contact having a wire trap configured to receive a wire therein in a wire loading direction through the bottom of the housing from the rear side of the substrate, the wire trap having a spring finger having a distal end configured to dig into the wire to trap the wire in the wire trap, the poke-in contact having a mounting leg, the mounting leg extending from the head and configured to be mounted to the front side of the substrate.

2. The connector assembly of claim 1, wherein the mounting leg includes a mounting surface configured to be mounted to the front side of the substrate, the mounting surface facing the bottom of the housing.

3. The connector assembly of claim 1, wherein the head includes a ledge facing the bottom of the housing, the ledge is configured to face the front side of the substrate.

4. The connector assembly of claim 1, wherein the wire trap is positioned within the body and is configured to be located between the front side and the rear side of the substrate.

5. The connector assembly of claim 1, wherein the contact channel, at the bottom, is sized to receive the wire and is shaped to guide the wire into the poke-in contact.

6. The connector assembly of claim 1, wherein the head includes a head bottom opposite the top, the body extending from the head bottom, the mounting leg having a mounting surface generally co-planar with the head bottom.

7. The connector assembly of claim 1, wherein the housing includes a substrate engagement surface configured to engage an interior of the opening of the substrate, the substrate engagement surface being located between the top and the bottom of the housing.

8. The connector assembly of claim 1, wherein the wire trap includes a barrel defining a bore configured to receive the wire therein, the spring finger extending from the barrel into the bore to engage the wire.

9. The connector assembly of claim 1, wherein the head includes a contact slot at the top, the mounting leg being received in the contact slot and extending from the contact channel to an edge of the head in the contact slot such that the mounting leg is recessed below the top of the head.

10. The connector assembly of claim 1, wherein the poke-in contact is a power contact configured to transmit power from the wire to the substrate.

11. A connector assembly for mounting to a substrate having an opening extending between a front side and a rear side, the connector assembly comprising:

a housing configured to extend through the opening of the substrate such that a portion of the housing is forward of the front side of the housing and such that a portion of the housing is rearward of the rear side of the housing, the housing having a contact channel extending therethrough, the contact channel being configured to receive a wire through a bottom of the housing; and a poke-in contact received in the contact channel, the poke-in contact having a wire trap configured to receive a wire therein in a wire loading direction from the rear side of the substrate, the wire trap having a spring finger having a distal end configured to dig into the wire to trap the wire in the wire trap, the poke-in contact having a mounting leg having a mounting surface, the mounting leg extending from the housing proximate to a top of the housing, the mounting surface being configured to be mounted to the front side of the substrate, the mounting surface facing the bottom of the housing.

12. The connector assembly of claim 11, wherein the head includes a ledge facing the bottom of the housing, the ledge is configured to face the front side of the substrate.

13. The connector assembly of claim 11, wherein the head includes a contact slot at the top, the mounting leg being received in the contact slot and extending from the contact channel to an edge of the head in the contact slot such that the mounting leg is recessed below the top of the head.

14. The connector assembly of claim 11, wherein the poke-in contact is a power contact configured to transmit power from the wire to the substrate.

15. The connector assembly of claim 11, wherein the wire trap includes a barrel defining a bore configured to receive the wire therein, the spring finger extending from the barrel into the bore to engage the wire.

16. A connector system comprising:

a substrate having a front side and a rear side, the substrate having an opening therethrough; and a connector assembly coupled to the substrate, the connector assembly comprising:

a housing having a body at a bottom of the housing and a head at a top of the housing, the head extending along the front side of the substrate, the body extending from the head through the opening such that the bottom is rearward of the rear side, the housing having a contact channel extending therethrough being open at the top and the bottom of the housing; and a poke-in contact received in the contact channel through the top of the housing, the poke-in contact having a wire trap configured to receive a wire therein in a wire loading direction through the bottom of the housing, the wire trap having a spring finger having a distal end configured to dig into the wire to trap the wire in the wire trap, the poke-in contact having a mounting leg, the mounting leg extending from the head and mounted to the front side of the substrate.

17. The connector system of claim 16, wherein the mounting leg includes a mounting surface mounted to the front side of the substrate, the mounting surface facing the bottom of the housing.

18. The connector system of claim 16, wherein the head includes a ledge facing the bottom of the housing, the ledge faces the front side of the substrate.

19. The connector system of claim 16, wherein the poke-in contact is a power contact transmitting power to at least one electrical component of the substrate.

20. The connector system of claim 16, wherein the head includes a contact slot at the top, the mounting leg being received in the contact slot and extending from the contact channel to an edge of the head in the contact slot such that the mounting leg is recessed below the top of the head.

* * * * *